United States Patent [19]

Munroe

[11] Patent Number: 4,585,902

[45] Date of Patent: Apr. 29, 1986

[54] PUSH-IN ELECTRICAL WIRE CONNECTOR

[75] Inventor: Ronald G. Munroe, Staten Island, N.Y.

[73] Assignee: Eagle Electric Mfg. Co., Inc., Long Island City, N.Y.

[21] Appl. No.: 699,804

[22] Filed: Feb. 8, 1985

[51] Int. Cl.[4] ..... H01R 11/01

[52] U.S. Cl. ..... 174/87; 174/84 S; 339/95 D; 403/215

[58] Field of Search ..... 174/84 S, 87; 339/95 D; 403/214, 215, 216

[56] References Cited

U.S. PATENT DOCUMENTS

| | | | |
|---|---|---|---|
| 2,122,252 | 6/1938 | Hayes | 174/87 |
| 3,132,202 | 5/1964 | Wolf | 174/87 |
| 3,918,784 | 11/1975 | Lemke et al. | 339/95 D |
| 4,036,545 | 7/1977 | Mysiak et al. | 339/95 D |
| 4,150,251 | 4/1979 | Scott | 174/87 |
| 4,212,509 | 7/1980 | Brooks et al. | 339/95 D |

FOREIGN PATENT DOCUMENTS

| | | | |
|---|---|---|---|
| 1559498 | 3/1969 | France | 339/95 D |

*Primary Examiner*—A. T. Grimley
*Assistant Examiner*—Morris H. Nimmo
*Attorney, Agent, or Firm*—Kirschstein, Kirschstein, Ottinger & Israel

[57] ABSTRACT

A push-in electrical wire connector for interconnecting at least two electrical wires includes a housing and a wire-clamping member mounted therein. The clamping member has apertures through each of which a respective conductor is insertable, and a resilient clamping portion extending lengthwise of the housing in an overlying relationship with an interior support wall. Due to its resilience, the clamping portion deflects from an initial position to a deflected position in which the clamping portion electromechanically engages and constantly urges the inserted conductor against the support wall.

10 Claims, 5 Drawing Figures

FIG. 3
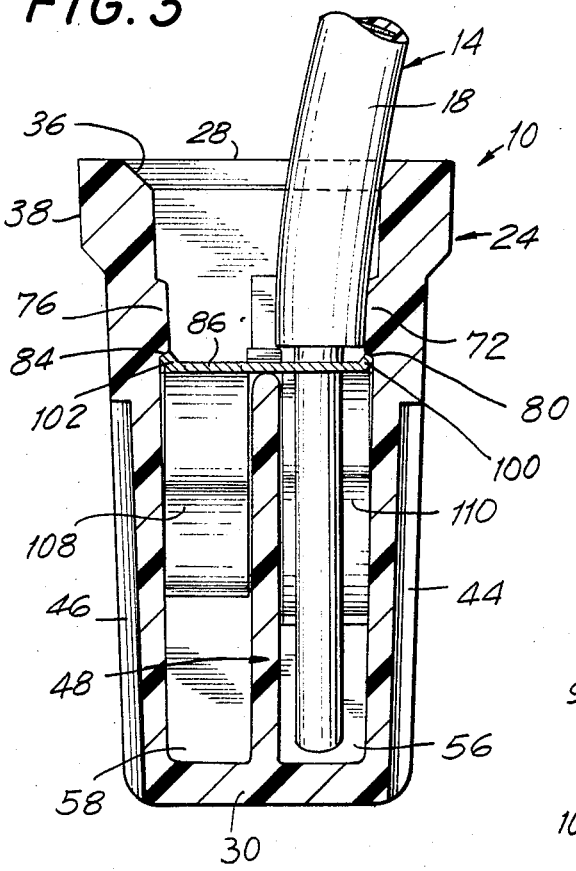
FIG. 5
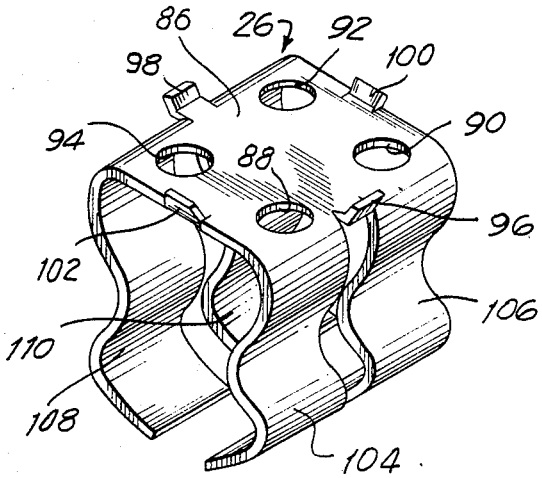
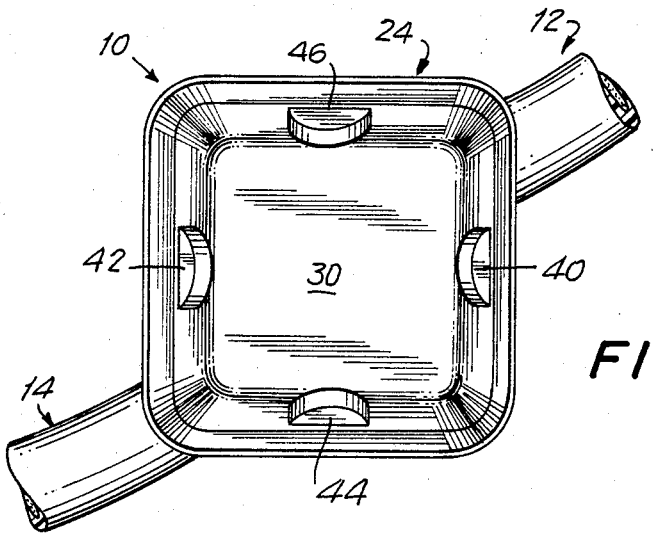
FIG. 4

PUSH-IN ELECTRICAL WIRE CONNECTOR

BACKGROUND OF THE INVENTION

1. Field of the Invention

This invention relates, generally, to an electrical wire connector and, more particularly, to a push-in connector for electromechanically interconnecting two or more electric conductors.

2. Description of the Prior Art

In branch wiring of electrical circuits, it is commonplace to employ wire nuts for interconnecting electrical conductors. Typically a pair of jacketed electrical wires to be interconnected have their exterior insulation at their free ends stripped away to expose the interior electrical conductors. The exposed conductors are formed or twisted together, and then inserted into the interior of a threaded tubular sheath, a so-called wire nut, which, when turned about the conductors, threads them down deeper into the threaded sheath and causes the conductors to be held securely within the nut. For maximum insulation penetration into the nut, the stripped length of each bare conductor has to be varied in accordance with the number of conductors being interconnected, because more conductors will not screw down as far as fewer conductors will.

Although generally satisfactory for their intended purpose, the use of wire nuts has not proven to be altogether convenient or effective in practice. It takes time for an installer to bend or twist the conductors together prior to their insertion into the nut, and it takes more time for the installer to turn the nut multiple turns to secure the interconnection of the conductors. In many applications, particularly where a multitude of wires are to be interconnected, it is very desirable to minimize this assembly time involved in making these interconnections. Also, despite one's best efforts, it sometimes happens that one or more of the wires are not gripped by a sufficient number of thread coils and become detached from their nuts, thereby causing the wires to become disconnected or exposing the installation to the hazard of shortcircuit or arcing which could lead to electrical fire.

SUMMARY OF THE INVENTION

1. Objects of the Invention

It is a general object of the present invention to overcome the aforementioned drawbacks of prior art wire nuts.

It is another object of the present invention to reliably interconnect electrical conductors without having to form or twist them together beforehand or expending time in doing so.

It is a further object of the present invention to reliably interconnect electrical conductors without having to apply multiple turns of a nut about the conductors and without expending the time in doing so.

It is yet another object of the present invention to more quickly and easily interconnect two or more electrical conductors by simply pushing the latter into a protective sheath or housing.

It is still another object of the present invention to reliably and securely hold the conductors within a sheath without having the conductors fall out or otherwise become detached therefrom.

It is a still further object of the present invention to reliably make an affirmative and secure electromechanical interconnection between two or more electrical conductors without resorting to a complex multi-part construction.

It is another object of the present invention to provide a push-in electrical wire connector which is inexpensive to manufacture, easy to use, durable in construction, of bipartite construction, cost effective in terms of assembly, labor saving, and reliable in use.

2. Features of the Invention

In keeping with these objects, and others which will become apparent hereinafter, one feature of the invention resides, briefly stated, in a push-in electrical wire connector of two-part construction, namely, a housing of electrically-insulating material, and a wire-clamping member of electrically-conductive material.

The housing has a general cup-shape, and is symmetrical about a longitudinal axis. The housing has an open end through which at least two electrical conductors are insertable, a closed end opposite to the open end, and a side wall intermediate the open and closed ends and circumferentially bounding an interior space. The housing includes at least two support walls integral therewith and located within the interior space. The support walls subdivide the interior space into at least two compartments, each of which receives a respectively inserted cable. The support walls extend from the closed end lengthwise along the housing, and terminate short of the open end in free edges which lie in a first common plane.

The housing still further includes at least two radial projections on an inner circumferential surface of the side wall, and extending inwardly into the interior space. The projections are spaced equi-angularly about the axis, and are located between the open and closed ends of the housing. The projections have abutment surfaces which lie in a second common plane parallel to the first common plane. The first and second planes are slightly spaced apart in an axial direction from each other.

The wire-clamping member is mounted within the interior space, and includes a radially extending, generally planar, apertured portion having at least two apertures through each of which a respective conductor is insertable. At least two bent tabs extend out of the plane of the apertured portion and respectively engage the abutment surfaces of the projections at one side of the apertured portion. The free edges of the support walls supportably engage the apertured portion at the opposite side thereof. Thus, the apertured portion is securely supported and fixed in position between the abutment surfaces, on the one hand, and the free edges, on the other hand.

The clamping member also includes at least two resilient clamping portions or arms of one piece with the apertured portion, and extending from the latter lengthwise along the housing toward the closed end in an overlying relationship with the support walls. Each clamping portion has a hinged end region attached to the apertured portion adjacent one of the apertures therein, a free end region opposite the hinged end region, and an auxiliary contact region intermediate the hinged and free end regions. Due to its inherent resilience, each clamping portion is deflectable from an initial position in response to the insertion of a respective conductor between the respective clamping portion and its associated support wall, to a deflected position in which the respective clamping portion electromechanically engages and constantly urges the inserted respective conductor against the associated support wall. In effect, each clamping portion clamps the inserted respective conductor securely within the housing.

Hence, in accordance with this invention, at least two electrical conductors may be pushed into the housing and reliably and securely held therein in an affirmative and secure electromechanical interconnection without resort to a multi-part construction, without having to bend or twist the wires together beforehand, without having to turn a sheath about the conductors, and without having the conductors becoming detached from the sheath or each other.

In accordance with another feature of this invention, each of the aforementioned hinged, free and auxiliary contact regions make electromechanical contact with the inserted respective conductor at spaced-apart locations therealong. This redundancy ensures that at least one electrical connection will be made.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a sectional view taken along line 3—3 of FIG. 1;

FIG. 4 is a bottom plan view of the push-in electrical wire connector in accordance with this invention; and FIG. 5 is an enlarged perspective view of a detail of the connector.

DETAILED DESCRIPTION OF THE PREFERRED EMBODIMENTS

Figure 2:
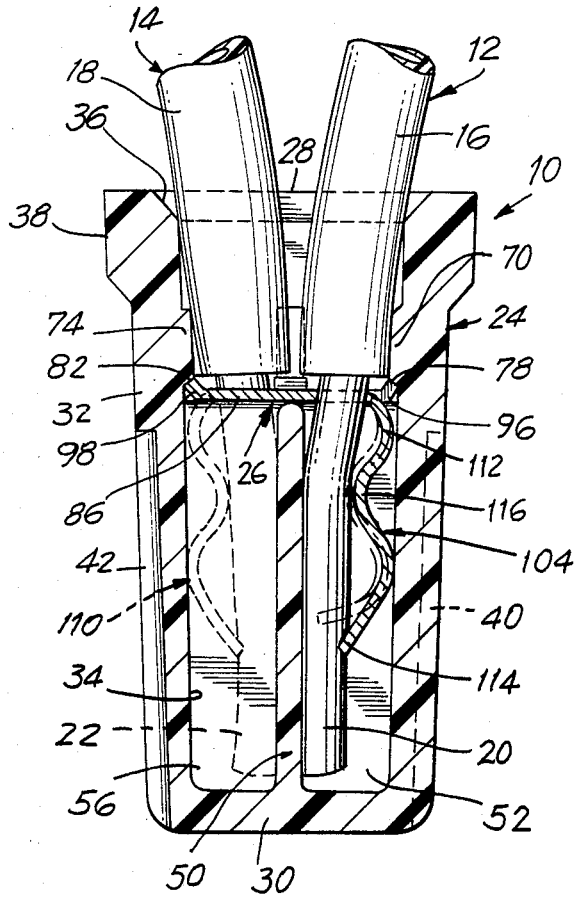
FIG. 2 is a sectional view taken along line 2—2 of FIG. 1.

Referring now to the drawings, reference numeral 10 generally identifies a push-in electrical wire connector in accordance with this invention for interconnecting a pair of electrical wires 12, 14 of the type having an outer jacket of electrical insulation surrounding an inner core or metallic conductor. As shown in FIG. 2, the outer insulations 16, 18 of wires 12, 14, respectively, have been stripped off the ends of the wires to expose the conductors 20, 22. The conductors are composed of solid metal, preferably copper, but cores of stranded wire are also within the spirit of this invention. Although only two wires are shown in the drawings as being inserted into the connector 10, three, four or more conductors can be interconnected as described below.

The connector 10 has two parts which are easily assembled together. The first part is a protective sheath or housing 24 made of electrically insulating material such as synthetic plastic material. The second part is a contact spring or resilient clamping member 26 made of electrically conductive material such as metal and, in a preferred case, is made of a hardenable high-conductivity brass alloy such as type No. 688 manufactured by the Olin Corporation (see FIG. 5).

As shown in FIGS. 2 and 3, the housing 24 is generally cup-shaped, extends along a longitudinal axis and is symmetrical about the same. The housing 24 has an open end 28 through which the conductors are insertable with clearance, a closed end or base 30 opposite the open end 28, and a side wall 32 intermediate the open and closed ends and circumferentially bounding an interior space 34. As considered in the direction of insertion, the open end 28 has at an inner circumferential surface of the side wall an inwardly converging bevel or chamfer 36 to facilitate insertion of the conductors. At the outer circumferential surface of the side wall 32, an annular lip or flange 38 surrounds the open end and provides a convenient hand-hold for a user during the insertion of the conductors. In addition, longitudinally-extending grooves 40, 42, 44, 46 are formed in the exterior circumferential surface of the side wall, at least partially along the length thereof, to provide a grasping surface to facilitate the insertion of the conductors, to reduce the weight and associated cost of the connector, and to act as a gauge to indicate the amount of insulation to be stripped off each wire.

Figure 1:
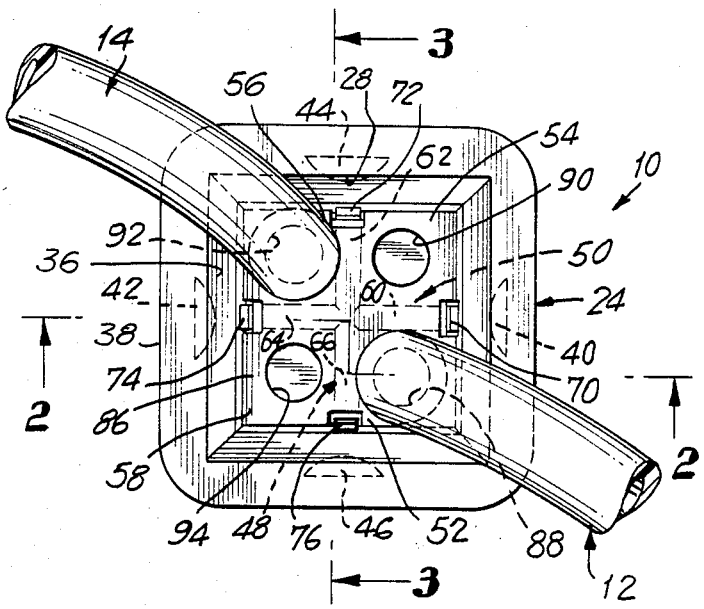
FIG. 1 is a top plan view of a push-in electrical wire connector showing a pair of broken-away electrical wires inserted therein.

At least two support walls 48, 50 are located within the interior space 34, and subdivide the same into four compartments 52, 54, 56, 58, each of which is adapted to receive, with slight clearance, a single conductor. The support walls are generally planar, are integral with the base, and extend from the base lengthwise along the housing and terminate short of the open end 28 thereof in a plurality of free edges 60, 62, 64, 66 (see FIG. 1). The free edges are located at the same elevation and lie in a common plane and, as will be described below, these free edges together cooperate to form a support surface or shelf on which the clamping member 26 is supported from below.

Integrally molded in the inner circumferential surface of the housing are four radial projections 70, 72, 74, 76 which extend inwardly into the interior space 34. The projections are equi-angularly spaced, e.g. at 90° intervals, about the axis of symmetry. As best shown in FIGS. 2 and 3, the projections are undercut to form respective abutment surfaces 78, 80, 82, 84 which lie at the same elevation and in a common plane. The plane in which the abutment surfaces lie is generally parallel to, and offset at a higher elevation from, the plane in which the aforementioned free edges 60, 62, 64, 66 lie.

The clamping member 26 includes a transversely-extending, generally planar, apertured portion 86 having four apertures 88, 90, 92, 94 formed therein. Each such aperture is dimensioned to receive a respective conductor with clearance. As explained in further detail below, the upper major surface or side of the apertured portion 86 engages the abutment surfaces of the radial projections, and the lower major surface or side of the apertured portion 86 engages the free edges of the support walls. Thus, the apertured portion 86 is, in effect, captured on the opposite sides thereof between the abutment surfaces, on the one hand, and the free edges, on the other hand.

To capture and securely anchor the apertured portion 86 with a snap-type action, four bent resilient tongues or tabs 96, 98, 100, 102 are bent outwardly and upwardly from the plane of the apertured portion 86. It is the free ends of these tabs that respectively engage the abutment surfaces of the undercut radial projections.

During manufacture of the connector 10, the apertured portion 86 is inserted through the open end in the longitudinal direction toward the closed end. When the resilient tabs initially contact the radial projections, the tabs are deflected toward one another to permit further insertion of the apertured portion into the interior space 34. Eventually, the tabs clear the projections and, due to the inherent resilience of the tabs, each tab springs outwardly and returns toward its initial position and snaps behind the abutment surfaces of the undercut projections. As noted above, further movement of the apertured portion 86 toward the closed end is prevented because the apertured portion is supported by the free ends of the support walls. With the just-described arrangement, the apertured portion is securely held in place, since the axial distance between the abutment surfaces and the free edges corresponds to the effective axial thickness of the apertured portion.

The clamping member 26 also includes four resilient clamping portions or arms 104, 106, 108, 110 of one piece with the apertured portion 86, and extending from the latter lengthwise along the housing toward the closed end 30 in an overlying relationship with the support walls 48, 50. Each arm, for example, see representative arm 104 in FIG. 2, has a hinged end region 112 attached to the apertured portion adjacent aperture 88 therein, a free end region 114 opposite the hinged end region 112, and an auxiliary contact region 116 intermediate the hinged and free end regions.

During use, representative conductor 20 is initially inserted through the open end 28 and then, in the same linear motion, through the aperture 88 in the apertured portion 86. Thereupon, continued insertion of the conductor 20 toward the base 30 causes the auxiliary contact region 116 to be deflected radially outwardly. Further insertion of the conductor 20 toward the base 30 causes the free end region 114 also to be deflected radially outwardly. During the outward deflection of the contact and free end regions of the clamping arm 104, the hinged end region 112 also flexes outwardly. Arm 104 is deflected from its initial unstressed position closely overlying its adjacent support wall to a deflected stressed position in which the arm 104 electromechanically engages and constantly urges the inserted conductor 20 against the associated support wall. Each of the regions of the arm 104 makes electromechanical contact with the inserted conductor 20 when the latter is fully inserted into the housing 10 at spaced-apart locations along the conductor 20. Specifically, the trailing end of the conductor 20, i.e. adjacent the jacket 16, makes electromechanical contact with at least a section of the wall portions bounding the aperture 88; the leading end of the conductor 20 makes contact with the free end region 114 of the arm 104; and the intermediate region of the conductor 20 makes contact with the auxiliary contact region 116 of the arm 104. These three electromechanical contacts of the representative arm 104 with the single conductor 20 ensures a high degree of reliability due to their redundance, and assures a very strong securement of the wire without the necessity of twisting the conductor about another conductor as in the prior art.

To improve the electromechanical contact and anchoring action of the arms, the latter preferably are curved and recurved as shown, for example, in FIG. 2 for representative arm 104, wherein the hinged region 112 is curved radially outwardly along an arc of about 180°, the contact region 116 is curved in the opposite sense about another arc of about 180°, and the free end region 104 is curved in the opposite sense to contact region 116 about another arc of about 180°. The curving and reverse curving of the arms, as shown in FIG. 2, configures the arms with a ripple-like corrugated shape.

Thus, in accordance with this invention, at least two conductors may be simply inserted in a push-in manner into any two compartments of the connector, and electromechanical contact is made. A third conductor likewise can be connected to the first two by the simple expedient of pushing the third conductor into another one of the provided apertures in the apertured portion 86. A fourth conductor and, in some applications, more than four conductors, may similarly be inserted into a respective aperture in an analogous manner to make the electromechanical interconnection.

In a preferred embodiment, the apertures in the apertured portion 86 are sized to receive, with slight clearance, a No. 12 or No. 14 solid copper conductor, although, as will be readily understood by those skilled in the art, other conductor sizes may be employed.

Due to the symmetry of the housing 24, the clamping member 26 can be assembled in any one of four positions. This lends itself to automatic assembly of the housing part and the clamping member part.

It will be understood that each of the elements described above, or two or more together, may also find a useful application in other types of constructions differing from the types described above.

While the invention has been illustrated and described as embodied in a push-in electrical wire connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A push-in electrical wire connector, comprising:

a generally cup-shaped, longitudinally-extending housing of electrically insulating material, said housing including an open end through which electrical conductors are insertable, a closed end opposite the open end, and a side wall intermediate the open and closed ends and circumferentially bounding an interior space, said housing also including a support means within the interior space and extending from the closed end lengthwise along the housing and terminating short of the open end; and a wire-clamping member of electrically conductive material mounted within the interior space, said clamping member including a transversely-extending apertured portion mounted in supported engagement with the support means between the open and closed ends of the housing and having apertures through each of which a respective conductor is insertable, said clamping member also including a resilient clamping portion integrally connected to the apertured portion and extending from the apertured portion lengthwise along the housing toward the closed end in an overlying relationship with the support means, said clamping portion, due to its inherent resilience, being deflectable from an initial position in response to insertion of a respective conductor between the clamping portion and the support means, to a deflected position in which the clamping portion electromechanically engages and constantly urges an insertable respective conductor against the support means.

2. The connector as defined in claim 1, wherein said housing is symmetrical about a longitudinal axis, and has at least two radial projections extending inwardly of the side wall into the interior space and equi-angularly spaced about the axis, said projections supportably engaging the apertured portion of the clamping member at one side thereof; and wherein said support means supportably engages the apertured portion at an opposite side thereof to fixedly secure the clamping member.

3. The connector as defined in claim 2, wherein said apertured portion is generally planar and has at least two bent tabs extending out of the plane of the apertured portion, each tab engaging a respective projection with snap action.

4. The connector as defined in claim 1, wherein said support means includes two generally planar support walls, said support walls intersecting each other at right angles and subdividing the interior space of the housing into four compartments, each for receiving a respectively insertable conductor.

5. The connector as defined in claim 4, wherein said support walls are of one piece with the housing and respectively have free edges which lie in a common plane, said free edges engaging and supporting the apertured portion.

6. The connector as defined in claim 1, wherein said clamping member includes another resilient clamping portion, each clamping portion having a hinged end region attached to the apertured portion, a free end region opposite the hinged end region, and an auxiliary contact region intermediate the hinged and free end regions, each of said regions electro-mechanically engaging the insertable respective conductor at spaced-apart locations therealong.

7. The connector as defined in claim 6, wherein each clamping portion has arcuate bends along its length.

8. The connector as defined in claim 1, wherein said side wall of the housing is chamfered at an inner circumferential surface thereof adjacent the open end to facilitate insertion of a conductor.

9. The connector as defined in claim 1, wherein said housing has an exterior lip adjacent the open end to facilitate gripping of the housing during insertion of a conductor.

10. A push-in electrical wire connector, comprising:

a generally cup-shaped, longitudinally-extending housing of electrically insulating material symmetrical about a longitudinal axis, said housing including an open end through which at least two electrical conductors are insertable, a closed end opposite the open end, and a side wall intermediate the open and closed ends and circumferentially bounding an interior space, said housing also including at least two support walls within the interior space and subdividing the same into at least two compartments, each of which receives a respectively inserted cable, said support walls being integral with, and extending from, the closed end lengthwise along the housing and terminating short of the open end in free edges which lie in a first common plane, said housing also including at least two radial projections on an inner circumferential surface of the side wall and extending inwardly into the interior space, said projections being equi-angularly spaced about the axis and located between the open and closed ends of the housing, said projections having abutment surfaces which lie in a second common plane parallel to the first common plane; and a wire-clamping member of electrically conductive material mounted within the interior space, said clamping member including a radially-extending, generally planar, apertured portion having at least two apertures through each of which a respective conductor is insertable, and at least two bent tabs extending out of the plane of the apertured portion and respectively engaging the abutment surfaces of the projections at one side of the apertured portion, said free edges of the support walls supportably engaging the apertured portion at the opposite side thereof, said clamping member also including at least two resilient clamping portions of one piece with the apertured portion and extending from the latter lengthwise along the housing toward the closed end in an overlying relationship with the support walls, each clamping portion having a hinged end region attached to the apertured portion adjacent one of the apertures therein, a free end region opposite the hinged end region, and an auxiliary contact region intermediate the hinged and free end regions, each clamping portion, due to its inherent resilience, being deflectable from an initial position in response to insertion of a respective conductor between the respective clamping portion and the associated support wall, to a deflected position in which the respective clamping portion electromechanically engages and constantly urges the inserted respective conductor against the associated support wall, each of said regions of the respective clamping portion making electromechanical contact with the inserted respective conductor at spaced-apart locations therealong.

* * * * *